US010497344B2

(12) United States Patent
Pond

(10) Patent No.: US 10,497,344 B2
(45) Date of Patent: Dec. 3, 2019

(54) PERCUSSION INSTRUMENT DEVICE

(71) Applicant: Isaac Pond, San Francisco, CA (US)

(72) Inventor: Isaac Pond, San Francisco, CA (US)

( * ) Notice: Subject to any disclaimer, the term of this patent is extended or adjusted under 35 U.S.C. 154(b) by 0 days.

(21) Appl. No.: 15/977,514

(22) Filed: May 11, 2018

(65) Prior Publication Data

US 2018/0261193 A1 Sep. 13, 2018

(51) Int. Cl.
*G10D 13/02* (2006.01)

(52) U.S. Cl.
CPC ..... *G10D 13/021* (2013.01)

(58) Field of Classification Search
CPC ..... G10D 13/021
See application file for complete search history.

(56) References Cited

U.S. PATENT DOCUMENTS

2014/0174277 A1 6/2014 Mann

OTHER PUBLICATIONS https://www.youtube.com/watch?v=DRNQTG-ulyU, Transient Roo, ALL (Year: 2013).*

* cited by examiner

*Primary Examiner* — Kimberly R Lockett
(74) *Attorney, Agent, or Firm* — Patentfile, LLC; Bradley C. Fach; Steven R. Kick

(57) ABSTRACT

A percussion instrument device may include a first container having a first lid, and a second container having a second lid. A first cavity may be defined by the first container and first lid, and the first cavity may contain a first air space and a first liquid. A second cavity may be defined by the second container and second lid, and the second cavity containing a second air space and a second liquid. A framework may couple the first container to the second container so that the containers are prevented from contacting each other. The lids of the device may be percussed to produce various sounds. The framework may be tilted back and forth in a plurality of positions so that a variable amount of liquid in the containers touches the respective lids, allowing for dynamic pitch manipulation of sounds produced while playing the device by percussing the lids.

12 Claims, 6 Drawing Sheets

PERCUSSION INSTRUMENT DEVICE

FIELD OF THE INVENTION

This patent specification relates to the field of musical instruments. More specifically, this patent specification relates to a percussion musical instrument.

BACKGROUND

Percussion instruments come in various configurations and types. Some produce a single note with a single strike on one of multiple tuned surfaces, as in, for example, xylophones, which are comprised of multiple tuned bars or tubes, or groups of jars arranged on a stable surface and tuned to set pitches by partially filling them with water. Both of the player's hands are free when playing such multi-tonal percussion instruments, but these types of percussion instruments lack pitch bending ability. Conversely, pitches produced on hand drums with stretched drumheads, such as dumbeks, tabla or conga drums, can only be dynamically bent by using one hand, elbow or arm to apply pressure to different parts of the drumhead while striking it, but only one hand is left free to drum.

None of these examples or other known percussion instruments utilize pitch bending potential with multiple percussive surfaces and are capable of producing multiple base notes while leaving both the drummer's hands free. Therefore, there exists a need for novel percussion instrument devices that leave both the drummer's hands free and combine multiple sizes and/or shapes of percussive surfaces which may be used for producing a unique and dynamic array of sounds.

BRIEF SUMMARY OF THE INVENTION

A percussion instrument device is provided which may be used as a percussion instrument. In some embodiments, the device may include a first container having a first lid, and a second container having a second lid. A first cavity may be defined by the first container and first lid, and the first cavity may contain a first air space and a first liquid. A second cavity may be defined by the second container and second lid, and the second cavity containing a second air space and a second liquid. A framework may couple the first container to the second container, and the frame work may prevent the first container from contacting the second container.

In further embodiments, the device may include a first container having a first lid, and a second container having a second lid. A first cavity may be defined by the first container and first lid, and the first cavity may contain a first air space and a first liquid. A second cavity may be defined by the second container and second lid, and the second cavity containing a second air space and a second liquid. A framework may couple the first container and the second container to a resonant housing having a first resonant surface. The framework may prevent the first container from contacting the second container, and the frame work may prevent the first container and second container from contacting the first resonant surface.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
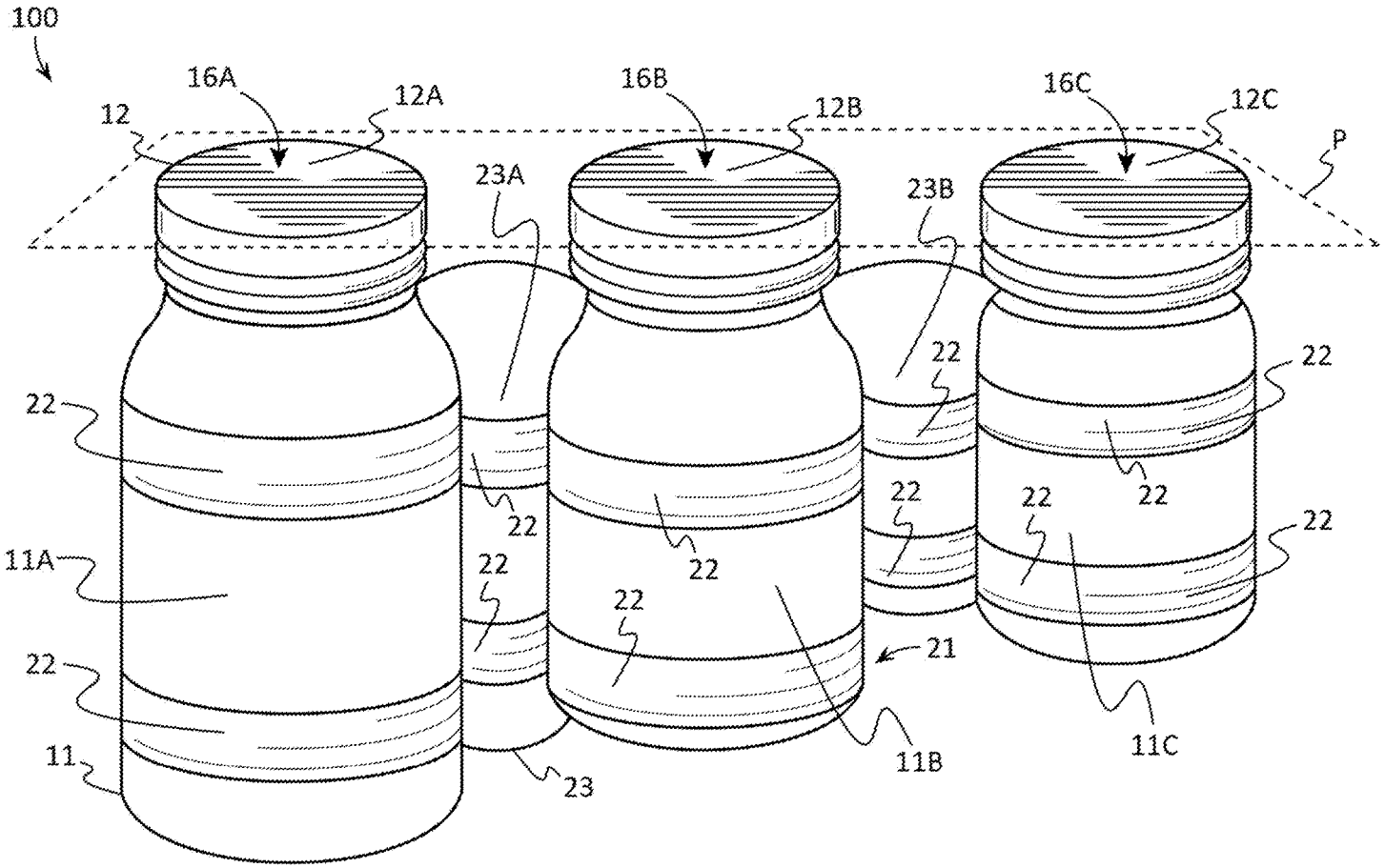
FIG. 1 depicts a perspective view of an example of a percussion instrument device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new percussion instrument device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1 and 4-7 illustrate examples of a percussion instrument device ("the device") 100 according to various embodiments. In some embodiments a device 100 may comprise one or more containers 11 and one or more lids 12. Each lid 12 may be coupled to a container 11, and each container 11 and its respective lid 12 may define a cavity 13 containing an air space 14 and a liquid 15. A framework 20 may couple each container 11 together so that each container 11 is prevented from contacting another container 11. The lids 12 of the device may be percussed, such as by being hit, struck, or otherwise impacted by a user to produce various sounds. The framework 21 may be tilted back and forth in a plurality of positions so that a variable amount of liquid 15 in the containers 11 touches the respective lids 12, allowing for dynamic pitch manipulation of sounds produced while playing the device 100 by contacting or percussing the lids 12. Optionally, the device 100 may comprise one or more resonant surfaces 41 which may be formed or coupled to a resonant housing 31, and the framework 21 may be coupled to the resonant housing 31. The resonant surfaces 41 may also percussed, such as by being hit, struck, or otherwise impacted, by a user to produce various sounds.

The device 100 may comprise one or more containers 11 each of which may be coupled to a lid 12 so that a cavity 13 may be defined of formed by a lid 12 and its respective container 11. In some embodiments, the device 100 may comprise a first container 11A and a second container 11B. In further embodiments, the device 100 may comprise a first container 11A, a second container 11B, and a third container 11C. In still further embodiments, the device 100 may comprise four, five, six, seven, eight, nine, ten, or more containers 11. A container 11 may be made from durable materials such as steel alloys, aluminum, aluminum alloys, copper alloys, other types of metal or metal alloys, ceramics such as alumina, porcelain, and boron carbide, earthenware, natural stone, synthetic stone, glass, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials.

In some embodiments, the device 100 may comprise two or more containers 11 which have cavities 13 that are of a different size. In further embodiments, the device 100 may comprise a first container 11A having a first cavity 13A and a second container 11B having a second cavity 13B, and the second cavity 13B may be between 99 and 50 percent of the size of the first cavity 13A. In still further embodiments, the device 100 may comprise a second container 11B having a second cavity 13B and a third container 11C having a third cavity 13C, and the third cavity 13C may be between 99 and 50 percent of the size of the second cavity 13B. In still further embodiments, the device 100 may comprise two or more containers 11 which have cavities 13 that are approximately the same size.

The device 100 may comprise a lid 12 for each container 11. Generally, a lid 12 may be coupled to a container 11 to close off or seal a cavity 13 that is bounded by the container 11 and its respective lid 12. Each lid 12 may be made from or may comprise a resonant material which may produce a sound when struck or percussed. A resonant material may include metals and metal alloys, porcelain, earthenware, natural stone, synthetic stone, glass, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, animal skins or animal membranes, mylar, or other synthetic drum skins, or any other material including combinations of materials.

Figure 2:
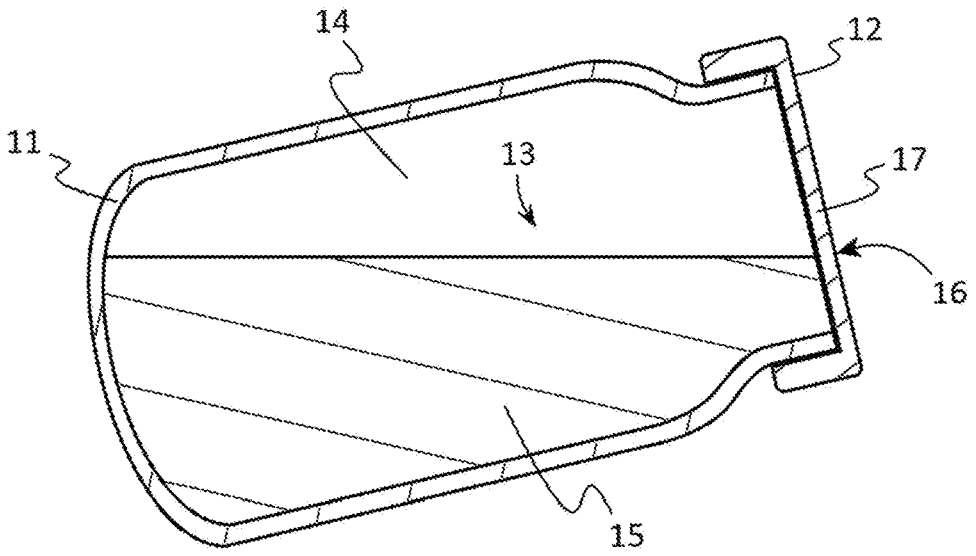
FIG. 2 illustrates a sectional view of an example of a container and lid having a liquid and an air space in a cavity according to various embodiments described herein.
Figure 3:
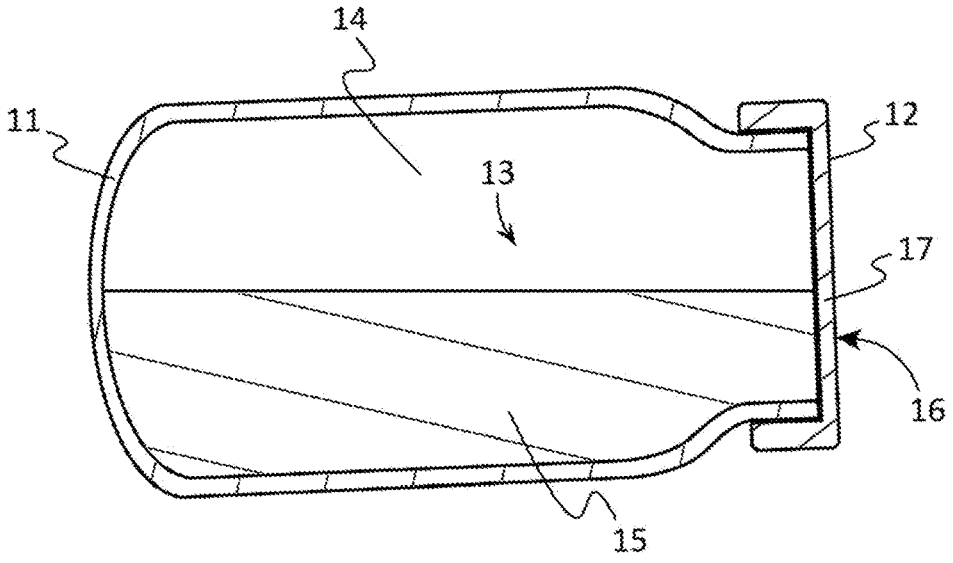
FIG. 3 shows a sectional view of another example of a container and lid having a liquid and an air space in a cavity according to various embodiments described herein.

Lids 12 of the device 100 may be configured in any shape and size. In preferred embodiments, each lid 12 may comprise a generally flat or planar drum surface 16 which a player may strike or percuss. In further embodiments, a lid 12 may comprise a relatively narrow and planar terminus 17 which may form a drum surface 16 and which may form the portion of the lid 12 which the contents of a cavity 13 may contact when the lid 12 is coupled to a container 11 as shown in FIGS. 2 and 3.

The drum surface 16 and terminus 17 may be configured with a generally circular shape or in any other shape. In some embodiments, the device 100 may comprise a lid 12 for each container 11 and each lid 12 may comprise a drum surface 16 which may be approximately the same size as the drum surface 16 of one or more of the other lids 12. In other embodiments, the device 100 may comprise a second container 11B having a second lid 12B with a drum surface 16 that is between 50 to 75 percent the size of a drum surface 16 of a first lid 12A of a first container 11A. In further embodiments, the device 100 may comprise a third container 11C having a third lid 12C with a drum surface 16 that is between 50 to 75 percent the size of a drum surface 16 of a second lid 12B of a second container 11B.

Figure 4:
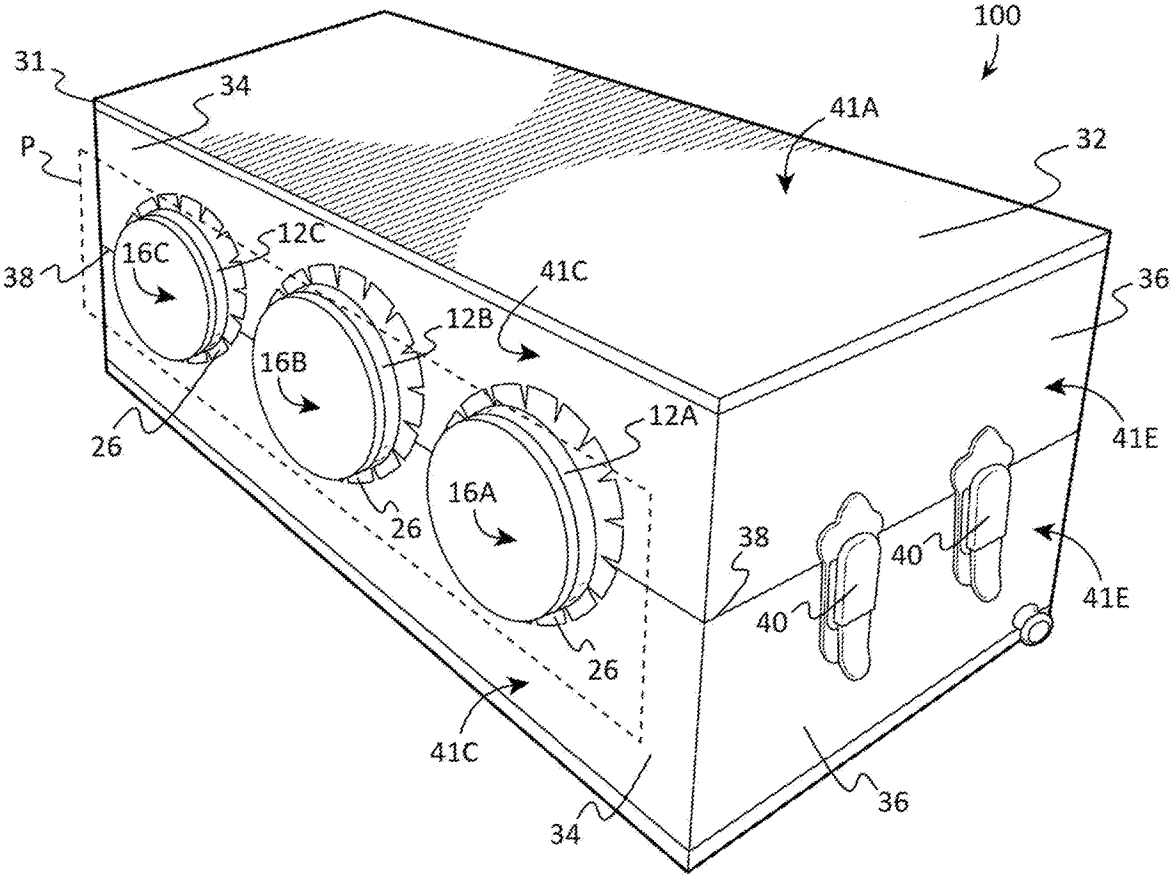
FIG. 4 depicts a top perspective view of an example of a percussion instrument device having a resonant housing according to various embodiments described herein.
Figure 5:
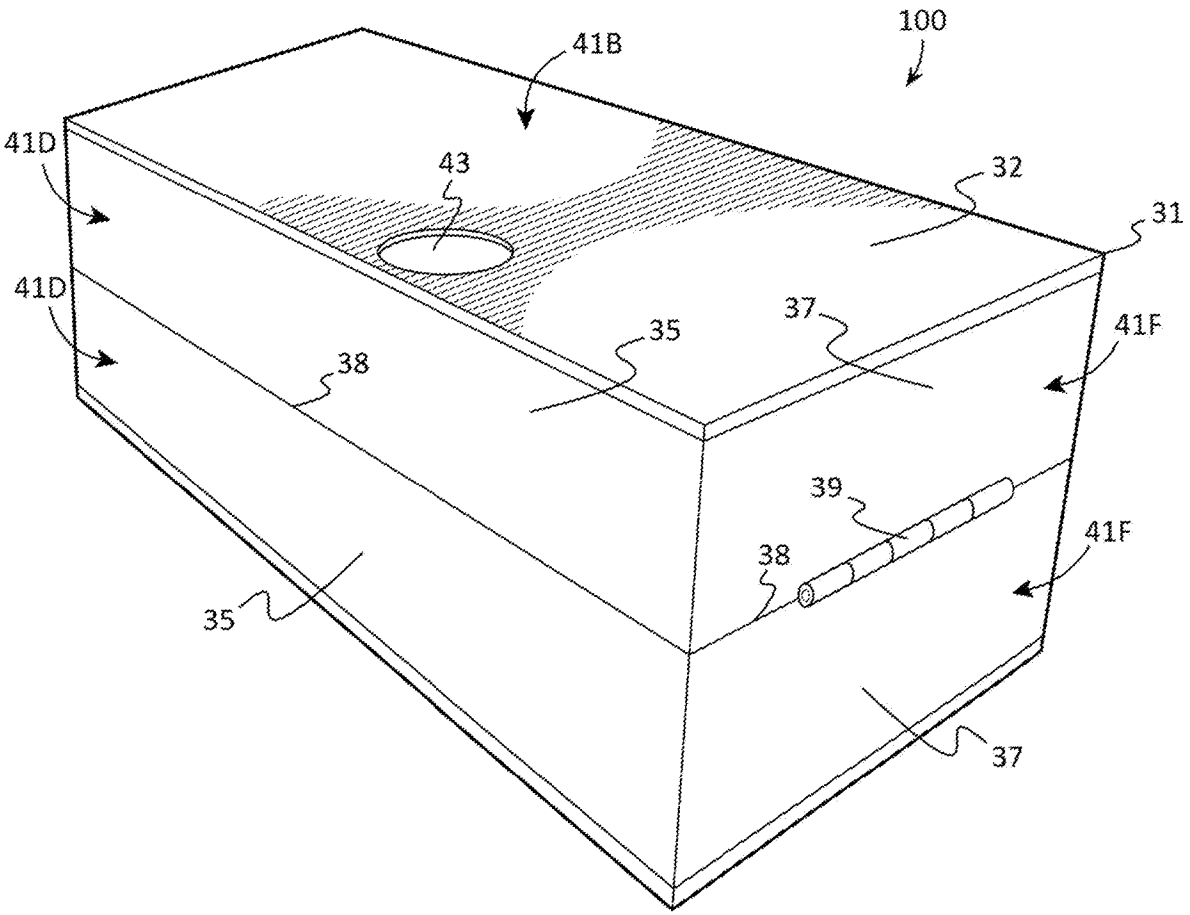
FIG. 5 illustrates a bottom perspective view of an example of a percussion instrument device having a resonant housing according to various embodiments described herein.

In some embodiments, the lids 12 of the device 100 may be configured with two or more lids 12 each having a planar shaped drum surface 16 and the drum surfaces 16 may be positioned in approximately the same plane as shown by plane P in in FIGS. 1 and 4. In further embodiments, the device 100 may comprise a first lid 12A having a planar shaped first drum surface 16A and a second lid 12B having a planar shaped second drum surface 16B, and the first drum surface 16A may be positioned in approximately the same plane as the second drum surface 16B. In still further embodiments, the device 100 may comprise a second lid 12B having a planar shaped second drum surface 16B and a third lid 12C having a planar shaped third drum surface 16C, and the second drum surface 16B may be positioned in approximately the same plane as the third drum surface 16C.

In some embodiments, a container 11 and a lid 12 may be removably coupled together with a threaded coupling method. For example, the container 11 and lid 12 may each comprise threading which may allow the container 11 and lid 12 to be threadedly engaged or coupled together. In other embodiments, a container 11 and a lid 12 may be coupled together so as to be generally non-removable from each other. For example, a lid 12 may be heat welded or otherwise bonded to a container 11. In alternative embodiments, a container 11 and lid 12 may be coupled together with any other suitable coupling method.

Each container 11 and lid 12 may be configured to form a cavity 13 which may be suitable for containing one or more liquids 15 and/or an air space 14. A liquid 15 may comprise any liquid substance which may reside in a liquid state at temperatures commonly encountered by musicians. Optionally, a liquid 15 may comprise any gaseous substance which may reside in a liquid state at pressures which may be maintained in a cavity 13 of the device 100. In preferred embodiments, a liquid 15 may comprise an aqueous solution of water and a water-soluble salt, such as sodium chloride, magnesium sulfate, or any other water-soluble material which may preferably be non-toxic. In further preferred embodiments, a liquid 15 may comprise an oil, such as mineral oil, any other oil formed by or containing a distillate of petroleum, corn oil, soybean oil, or any other vegetable oil, or any other oil that preferably may be non-toxic. In some embodiments, an air space 14 may comprise a gas such as air, nitrogen, helium, argon, neon, including combinations of gasses. In further embodiments, an air space 14 may comprise a partial or approximately complete vacuum.

In some embodiments, the device 100 may comprise one or more containers 11 that contain a liquid 15 and an airspace 14. The liquid in a container 11 may occupy a liquid volume, and the air space 14 in the container 11 may occupy a gas volume. In preferred embodiments, the gas volume may be between 50 to 75 percent of the liquid volume. In further embodiments, the gas volume may be between 5 to 50 percent of the liquid volume. In still further embodiments, the gas volume may be between 1 to 99 percent of the liquid volume.

The amount of liquid 15 and air space 14 which may contact the terminus 17 of a lid 12 may be altered by tipping a container 11 thereby altering the pitch of the sound produced when a user strikes or percusses the drum surface 16 of the lid 12. In the example of FIG. 2, the container 11 is tipped so that a greater amount of air space 14 is containing the terminus 17 of the lid 12 than the amount of air space 14 that is contacting the terminus 17 of the lid 12 in the example of FIG. 3. A percussed lid 12 that is contacted by a lesser amount of liquid 15 (FIG. 2) will produce a sound of a higher pitch than a percussed lid 12 that is contacted by a greater amount of liquid 15 (FIG. 3). By tilting the one or more containers 11 of the device 100 the user may dynamically alter the pitch of sounds produced by percussing the one or more lids 12.

In preferred embodiments, the device 100 may comprise a framework 21 which may couple the one or more containers 11 of the device 100 together so that by tilting or moving the framework 21, the one or more containers 11 may be likewise tilted or moved. In further preferred embodiments, framework 21 may couple two or more containers 11 together while separating the containers 11 so that they may not directly contact one or more other containers 11. For example, a framework 21 may couple a first container 11A, second container 11B, and third container 11C together, and the framework 21 may prevent the first container 11A, second container 11B, and third container 11C from contacting each other. In still further preferred embodiments, framework 21 may couple two or more containers 11 together so that the containers 11 are not able to move independently of each other. For example, a framework 21 may couple a first container 11A, second container 11B, and third container 11C together, and the framework 21 may prevent the first container 11A, second container 11B, and third container 11C from being able to move independently of each other.

FIG. 1 illustrates an example of a device 100 having a framework 21 that comprises one or more bands 22 of material which may surround portions of the containers 11A, 11B, 11C, and which may couple the containers 11A, 11B, 11C, together. In some embodiments, a band 22 may comprise a flexible material which may include synthetic fabrics such as polyester, polyamide, acrylic, nylon, rayon, acetate, spandex, spandex blends, and natural fabrics such as coir, cotton, terry cloth, hemp, jute, linen, ramie, wool, silk, flexible plastics which may include silicone foams, silicone rubber, rubber foams, urethane foams, plastic foams, neoprene foam, latex foam rubber, polyurethane foam rubber, flexible plastics, such as high-density polyethylene (HDPE), polyvinyl chloride (PVC), polypropylene (PP), Polystyrene (PS), Polycarbonate (PC), low density polyethylene (LDPE), deer hide, other animal skins and membranes, or any other flexible material including combinations of materials. In other embodiments, a band 22 may comprise substantially rigid materials such as steel alloys, aluminum, aluminum alloys, copper alloys, other types of metal or metal alloys, ceramics such as alumina, porcelain, and boron carbide, earthenware, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid. In alternative embodiments, the containers 11A, 11B, 11C, may be coupled directly to each other, such as with adhesive or by being integrally formed together, and the framework 21 may comprise the material that bonds the containers 11A, 11B, 11C, together.

In some embodiments, the device 100 may comprise one or more isolators 23 which may be positioned between two or more containers 11 and which may separate or insulate the containers 11 from each other. In preferred embodiments, an isolator 23 may be positioned between two or more containers 11, and the isolator 23 may vibrationally insulate the containers 11 from each other. In further embodiments, the device 100 may comprise a first isolator 23A with a framework 21 which couples a first container 11A to the first isolator 23A and also couples a second container 11B to the first isolator 23A in which the first isolator 23A separates the first container 11A from the second container 11B. In still further embodiments, the device 100 may comprise a second isolator 23B with a framework 21 which couples a second container 11B to the second isolator 23B and also couples a third container 11C to the second isolator 23B in which the second isolator 23B separates the second container 11B from the third container 11C.

In some embodiments, an isolator 23 may be made from or may comprise vibrationally insulating or isolating materials which may include elastomers, visco-elastic polyurethane materials, rubber, cork, foam materials, laminate materials, and the like. Elastomers may include unsaturated rubbers that can be cured by sulfur vulcanization, such as Natural polyisoprene: cis-1,4-polyisoprene natural rubber (NR) and trans-1,4-polyisoprene gutta-percha; Synthetic polyisoprene (IR for isoprene rubber); Polybutadiene (BR for butadiene rubber); Chloroprene rubber (CR), polychloroprene, Neoprene, Baypren etc.; Butyl rubber (copolymer of isobutylene and isoprene, IIR); Halogenated butyl rubbers (chloro butyl rubber: CIIR; bromo butyl rubber: BIIR); Styrene-butadiene Rubber (copolymer of styrene and butadiene, SBR); Nitrile rubber (copolymer of butadiene and acrylonitrile, NBR), also called Buna N rubbers; Hydrogenated Nitrile Rubbers (HNBR) Therban and Zetpol; and the like (Unsaturated rubbers can also be cured by non-sulfur vulcanization if desired), and Elastomers may also include Saturated rubbers that cannot be cured by sulfur vulcanization: EPM (ethylene propylene rubber, a copolymer of ethylene and propylene) and EPDM rubber (ethylene propylene diene rubber, a terpolymer of ethylene, propylene and adiene-component); Epichlorohydrin rubber (ECO); Polyacrylic rubber (ACM, ABR); Silicone rubber (SI, Q, VMQ); Fluorosilicone Rubber (FVMQ); Fluoroelastomers (FKM, and FEPM) Viton, Tecnoflon, Fluorel, Aflas and Dai-El; Perfluoroelastomers (FFKM) Tecnoflon PFR, Kalrez, Chemraz, Perlast; Polyether block amides (PEBA); Chlorosulfonated polyethylene (CSM), (Hypalon); Ethylene-vinyl acetate (EVA); and the like. Foam materials may include silicone foams, rubber foams, urethane foams including ARTiLAGE foams and Poron foams, plastic foams, neoprene foam, latex foam rubber, polyurethane foam rubber, such as polyether polyurethane foam and polyester polyurethane foam, or any other similar material. In further embodiments, an isolator 23 may be made from or may comprise synthetic fabrics such as polyester, polyamide, acrylic, nylon, rayon, acetate, spandex, spandex blends, and natural fabrics such as coir, cotton, terry cloth, hemp, jute, linen, ramie, wool, silk, or any other suitable flexible natural or synthetic material including combinations of materials.

Turning now to FIGS. 4-7, in some embodiments, the device 100 may comprise a resonant housing 31, and the framework 21 may couple the containers 11 to the resonant housing 31 so that the lids 12 are accessible to allow the drum surfaces 16 to be percussed. A resonant housing 31 may comprise one or more resonant surfaces 41, such as a first resonant surface 41A, a second resonant surface 41B, a third resonant surface 41C, a fourth resonant surface 41D, a fifth resonant surface 41E, a sixth resonant surface 41F, or any other number of resonant surfaces 41. Each resonant surface 41 may be made from or may comprise a resonant material which may produce a sound when struck or percussed. In preferred embodiments, a resonant surface 41 may be made from or may comprise poplar wood and/or red alder wood. In further preferred embodiments, a first resonant surface 41A and a second resonant surface 41B may be made from poplar wood, and a third resonant surface 41C and a fourth resonant surface 41D may be made from red alder wood. Other examples of resonant materials may include metals and metal alloys, porcelain, earthenware, natural stone, synthetic stone, glass, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, other types of wood, other plant based materials, animal skins or animal membranes, mylar, or other synthetic drum skins, or any other material including combinations of materials.

In preferred embodiments, a resonant housing 31 may be configured with a generally rectangular prism shape having one or more resonant surface 41 disposed on each side of the rectangular prism shape. In further embodiments, a resonant housing 31 may be formed via one or more sidewalls, such as a first sidewall 32, second sidewall 33, third sidewall 34, fourth sidewall 35, fifth sidewall 36, and a sixth sidewall 37. Preferably, a sidewall 32, 33, 34, 35, 36, 37, may form all or portions of a resonant surface 41. A sidewall 32, 33, 34, 35, 36, 37, may be made from durable materials and preferably from resonant materials. In further embodiments, a sidewall 32, 33, 34, 35, 36, 37, may comprise one or more sound apertures 43 which may comprise an opening, hole, channel, or other type of aperture which may facilitate sound emanation from the device 100 and may optionally serve as access for a microphone.

Optionally, one or more sidewalls 32, 33, 34, 35, 36, 37, may comprise a seam 38 which may allow the resonant housing 31 to be opened to allow access to the containers 11 and other elements within the resonant housing 31. In further embodiments, the device 100 may comprise a hinge 39 which may movably couple two or more sidewalls 32, 33, 34, 35, 36, 37, together. A hinge 39 may comprise a knuckle joint, a turnbuckle, a pin joint, a pivot joint, a cotter joint, a bolted joint, a flexible material joint, a screw joint, a universal joint, a butt hinge, butterfly hinge, flush hinge, barrel hinge, concealed hinge, continuous hinge, T-hinge, strap hinge, double-acting hinge, Soss hinge, a flexible material hinge, or any other type of movable coupling. In still further embodiments, the device 100 may comprise one or more fasteners 40 which may be configured to removably couple two or more sidewalls 32, 33, 34, 35, 36, 37, together. A fastener 40 may comprise a latch, a snap fastener, a turn-to-lock fastener, a threaded fastener, or any other removable fastener or coupling method.

Figure 6:
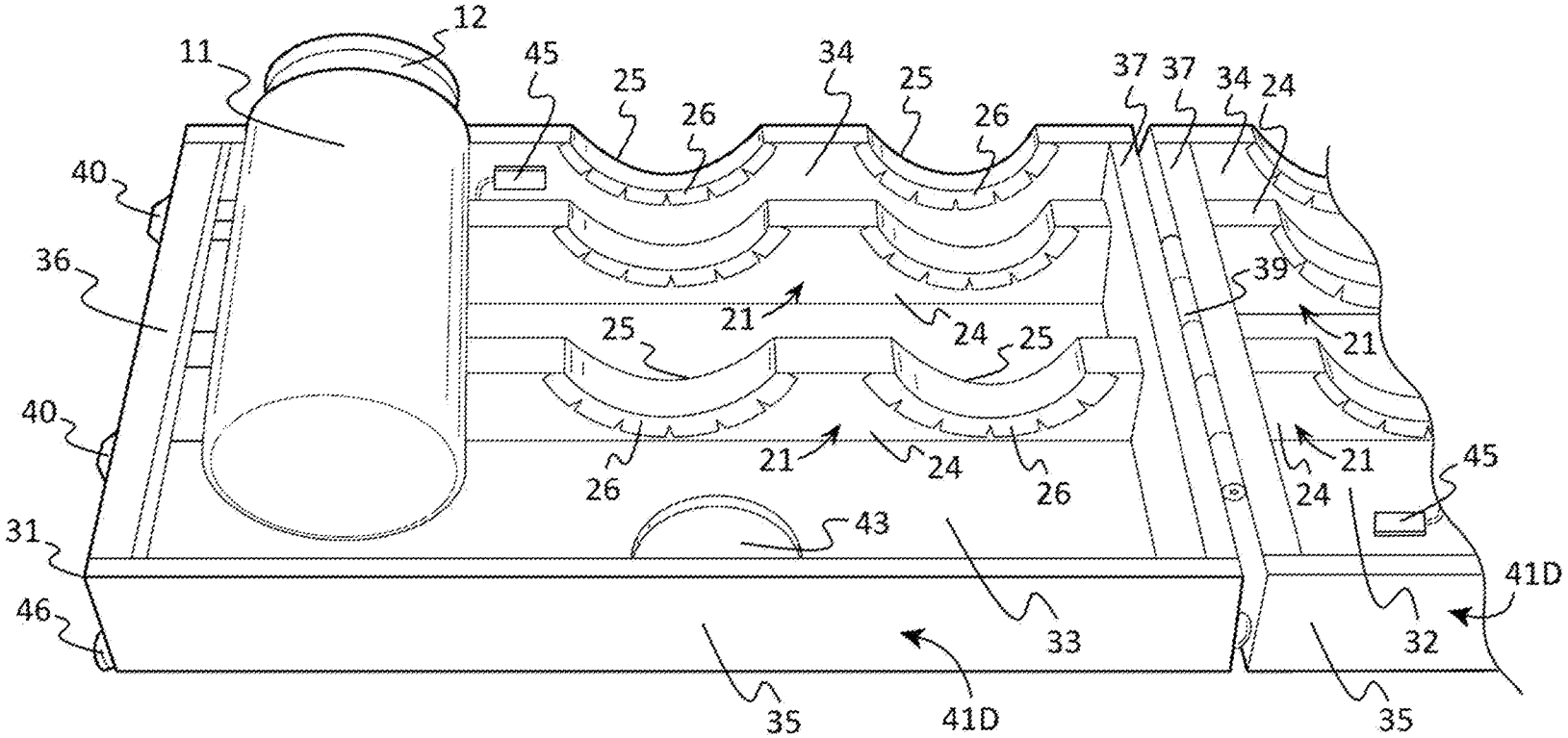
FIG. 6 shows a top partial perspective view showing the inside of an example resonant housing of a percussion instrument device according to various embodiments described herein.

In some embodiments, a frame work 21 may comprise one or more braces 24 which may be used to support and position portions of one or more container 11 within the resonant housing 31 as shown in FIG. 6. In preferred embodiments, a brace 24 may be made from a durable material and preferably from a resonant material, such as wood. In further preferred embodiments, one or more braces 24 may only be coupled to two opposing sidewalls, 32, 33, 34, 35, 36, 37, such as the fifth 36 and sixth 37 sidewall so that there may be no contact between the braces 24 and the other sidewalls 32, 33, 34, 35, and their respective resonant surfaces 41A, 41B, 41C, 41D, so that their respective resonant surfaces 41A, 41B, 41C, 41D, are able to vibrate freely.

In some embodiments, each brace 24 and one or more sidewalls 32, 33, 34, 35, 36, 37, such as a third sidewall 34, may comprise one or more depressions 25 which may be complementary in shape to the shape of the one or more containers 11 which are to be supported by the braces 24 so that the containers 11 may be positioned in and held in place by the depressions 25. For example, each brace 24 and a third sidewall 34 may each comprise concave curved depressions 25 which may be complementary in shape to the convex curved portions of the cylindrical containers 11. In further embodiments, the device 100 may comprise one or more cushions 26 which may be made from or may comprise a resilient material and which may be coupled to a brace 24. In preferred embodiments, a cushion 26 may be disposed in or may line a depression 25 and form the interface between a brace 24 and a container 11 supported by the brace 11 so that the cushion 26 prevents contact between the container 11 and the framework 21. In some embodiments, a resilient material may include a vibrationally insulating or isolating material such as which may be used to form an isolator 23. In other embodiments, a resilient material may include a flexible material such as which may be used to form a band 22.

Figure 7:
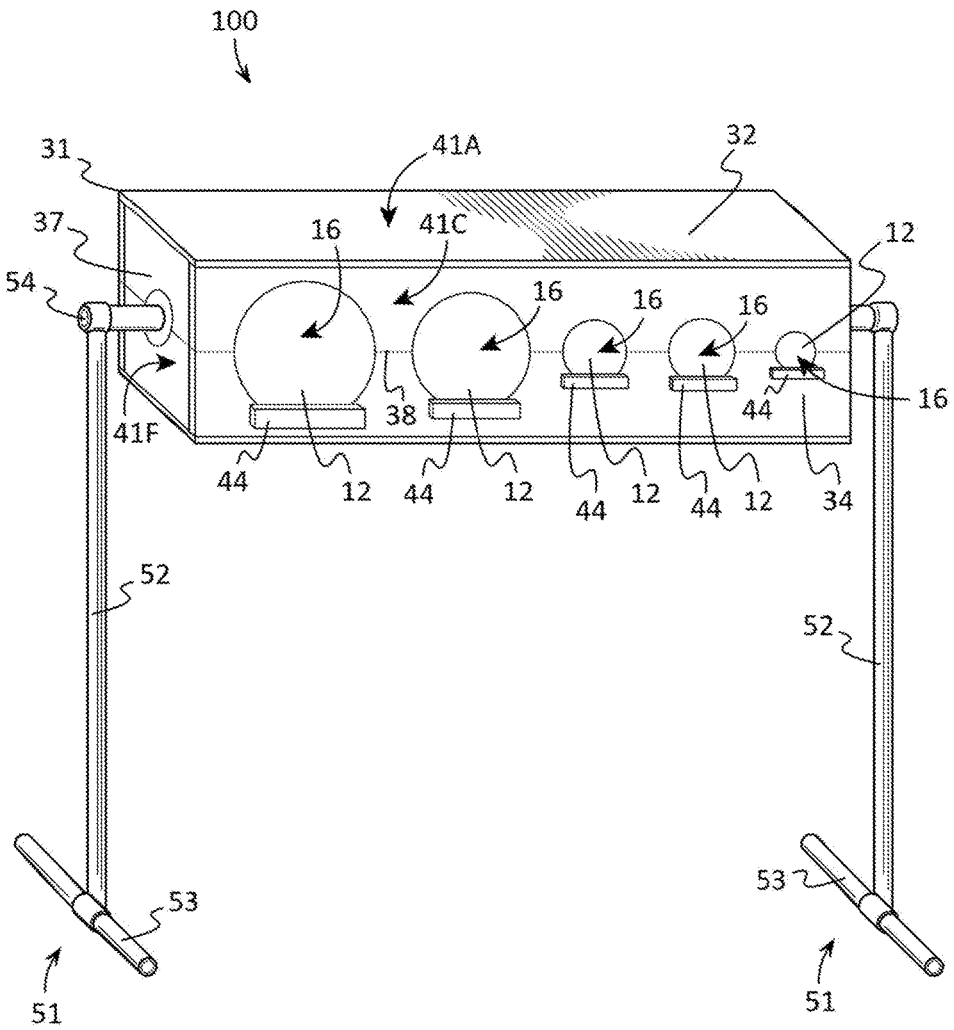
FIG. 7 depicts a perspective view of another example of a percussion instrument device according to various embodiments described herein.

Optionally, the device 100 may comprise one or more electrical sound outputs which may be configured to turn sounds and vibrations into electrical signals. In some embodiments, the device 100 may comprise one or more magnetic pickups 44 which may be coupled to an element of the device 100, such as to a container 11 and/or lid 12, which may be used to convent vibrations into an electrical signal. In preferred embodiments, a device 100 may comprise one or more magnetic pickups 44 which may be coupled to one or more, and more preferably to each, lid 12 of the device 100 as shown in FIG. 7. In further embodiments, the device 100 may comprise one or more piezo pickups 45 which may be coupled to an element of the device 100, such as a sidewall 32, 33, 34, 35, 36, 37, and therefore in vibrational communication with its respective resonant surface 41A, 41B, 41C, 41D, 41E, 41F, which may be used to convent vibrations into an electrical signal. In preferred embodiments, the device 100 may comprise a first piezo pickup 45 which may be coupled to the first sidewall 32 and a second piezo pickup 45 which may be coupled to the third sidewall 34 as shown in FIG. 6. A magnetic pickup 44 or a piezo pickup 45 may be provided electrical communication via a female plug member 46 which may be configured to receive and electrically communicate with a male plug member, such as a 3.5 mm stereo phone connector, male USB connector, or any other electrical connector commonly used to connect to electrical instruments.

In some embodiments and as shown by FIG. 7, the device 100 may comprise a stand 51 which may be configured to support a resonant housing 31 above a ground surface. Generally, a stand 51 may comprise one or more support legs 52 and one or more support feet 53. A support foot 53 may be configured to contact a ground surface while a support leg 52 may couple and support a resonant housing 31 to a support foot 53. In some embodiments, a support leg 52 may comprise a bearing 54 or other movable coupling which may be used to movably couple the resonant housing 31 to the support leg 52 so that the resonant housing 31 may be moved relative to the support leg 52 to modulate the amount of liquid 15 which may contact the one or more lids 12 of the device 100. In further embodiments, a support foot 53 may comprise a curved shape, similar to a rocking chair foot, which may allow the user to rock the device 100 to modulate the amount of liquid 15 which may contact the one or more lids 12 of the device 100.

While some exemplary shapes and sizes have been provided for elements of the device 100, it should be understood to one of ordinary skill in the art that the containers 11, lids 12, resonant surfaces 41, framework 21, resonant housing 31, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A percussion instrument device for use as a percussion instrument, the device comprising:

a first container having a first lid;

a first cavity defined by the first container and first lid, the first cavity containing a first air space and a first liquid;

a second container having a second lid;

a second cavity defined by the second container and second lid, the second cavity containing a second air space and a second liquid;

a resonant housing having a first resonant surface; and a framework, the framework coupling the first container and the second container to the resonant housing, wherein the framework prevents the first container from contacting the second container, and wherein the framework prevents the first container and second container from contacting the first resonant surface.

2. The device of claim 1, wherein the resonant surface comprises a resonant material.

3. The device of claim 1, wherein the resonant housing comprises a second resonant surface.

4. The device of claim 1, wherein the framework couples the first container and second container together so that the first container and second container are not able to move independently of each other.

5. The device of claim 1, further comprising at least one cushion, and wherein the at least one cushion prevents contact between the first container and the framework.

6. The device of claim 1, wherein the first liquid is an aqueous solution.

7. The device of claim 1, wherein the first liquid is an oil.

8. The device of claim 1, further comprising a third container, wherein the framework couples the first container, second container, and third container together, and wherein the framework prevents the first container, second container, and third container from contacting each other.

9. The device of claim 1, wherein the liquid in each container occupies a liquid volume, wherein the air space in each container occupies a gas volume, and wherein the gas volume may be between 50 to 75 percent of the liquid volume.

10. The device of claim 1, wherein the second cavity of the second container is between 99 and 50 percent of a size of the first cavity of the first container.

11. The device of claim 1, wherein the first lid comprises a first drum surface, wherein the second lid comprises a second drum surface, and wherein the first drum surface is positioned in approximately the same plane as the second drum surface.

12. The device of claim 1, wherein the framework is configured be tilted back and forth in a plurality of positions allowing for dynamic pitch manipulation of sounds produced while playing the device.

* * * * *